US005127380A

United States Patent [19]

Morishita

[11] Patent Number: 5,127,380

[45] Date of Patent: Jul. 7, 1992

[54] COMBUSTION CHAMBER AND VALVE OPERATING MECHANISM FOR MULTI-VALVE ENGINE

[75] Inventor: Isao Morishita, Iwata, Japan

[73] Assignee: Yamaha Hatsudoki Kabushiki Kaisha, Iwata, Japan

[21] Appl. No.: 735,350

[22] Filed: Jul. 24, 1991

Related U.S. Application Data

[62] Division of Ser. No. 357,474, May 26, 1989, Pat. No. 5,070,824.

[30] Foreign Application Priority Data

May 30, 1988 [JP] Japan ..... 63-134054
May 30, 1988 [JP] Japan ..... 63-134055
May 30, 1988 [JP] Japan ..... 63-134057

[51] Int. Cl.[5] ..... F01L 1/26; F02M 35/10

[52] U.S. Cl. ..... 123/432; 123/90.27; 123/90.4

[58] Field of Search ..... 123/90.27, 90.4, 193 H, 123/308, 432

[56] References Cited

U.S. PATENT DOCUMENTS

| | | | |
|---|---|---|---|
| 4,660,529 | 4/1987 | Yoshikawa | 123/432 |
| 4,671,222 | 6/1987 | Gallot et al. | 123/90.27 |
| 4,681,069 | 7/1987 | Honma | 123/90.27 |
| 4,732,119 | 3/1988 | Melde-Tuczai et al. | 123/90.27 X |
| 4,748,946 | 6/1988 | Fujii et al. | 123/90.27 X |
| 4,969,427 | 11/1990 | Hamada | 123/90.27 |

FOREIGN PATENT DOCUMENTS

| | | |
|---|---|---|
| 62-43050 | 9/1978 | Japan . |
| 57-102506 | 6/1982 | Japan . |
| 62-93123 | 6/1987 | Japan . |
| 2-40904 | 9/1988 | Japan . |
| 64-4045 | 1/1989 | Japan . |
| 1-145907 | 10/1989 | Japan . |
| 2-18603 | 2/1990 | Japan . |
| 2-61325 | 3/1990 | Japan . |
| 2-35844 | 8/1990 | Japan . |
| 3-15623 | 1/1991 | Japan . |

*Primary Examiner*—Tony M. Argenbright
*Attorney, Agent, or Firm*—Ernest A. Beutler

[57] ABSTRACT

A number of embodiments of multiple valve internal combustion engines embodying a single camshaft for operating all of the multiple valves. The cylinder head is configured in such a way that it is reinforced across the center of the cylinder head by a bridging member and this bridging member can form a bearing surface for a center lobe of the camshaft. The camshaft is offset toward one side of the cylinder head and operates the valves through a plurality of rocker arms. In some embodiment, the rocker arms are journaled on a cam cover upon rocker arm shafts formed with reliefs aligned with openings in the cam cover for passing components such as a spark plug or a fastener for securing the cam cover to the cylinder head. Both single and multiple cylinder embodiments are disclosed.

29 Claims, 11 Drawing Sheets

COMBUSTION CHAMBER AND VALVE OPERATING MECHANISM FOR MULTI-VALVE ENGINE

This is a division of U.S. patent application Ser. No. 357,474, filed May 26, 1989, now U.S. Pat. No. 5,070,924.

BACKGROUND OF THE INVENTION

This invention relates to a combustion chamber configuration and valve operating arrangement for a multi-valve engine.

It has been recognized that the performance of an internal combustion engine can be significantly improved by increasing the number of valves serving each of the combustion chambers. By using a plurality of smaller diameter valves rather than individual large diameter valves, it is possible to increase the total effective valve flow area without a significant increase in the weight of the reciprocating masses. As a result, multiple valve engines are receiving considerable interest and application for a wide variety of purposes, such as powering motor vehicles.

However, as the number of valves per combustion chamber increases, the complexity of the engine also increases. In addition, the added port areas necessary to serve the multiple valves tends to complicate the ability to provide a rigid cylinder head arrangement that can withstand the loadings.

It is, therefore, a principal object of this invention to provide an improved cylinder head arrangement for an internal combustion engine embodying a plurality of valves and wherein the cylinder head is formed with an integral reinforcing construction.

It is a further object of this invention to provide an improved arrangement for the cylinder head of an internal combustion engine having multiple valves wherein the cylinder head is reinforced by at least one bridging member that extends transversely across the cylinder head in proximity to the combustion chamber.

Although the use of such a bridging member or bridging members for reinforcing the cylinder head is particularly advantageous so as to provide a strong and yet lightweight construction, the use of bridging members by themselves can further complicate the overall configuration of the cylinder head and the formation of it. It is, therefore, a still further object of this invention to provide an improved cylinder head arrangement embodying a reinforcing bridging member that serves purposes in addition to merely reinforcing the cylinder head.

Where multiple intake valves are utilized in conjunction with internal combustion engines, it has been generally the practice to dispose all of the intake valves on one side of the engine and all of the exhaust valves on the other side of the engine. This is generally done so as to simplify the porting for the engine and so that the ports for the intake and exhaust gases need not cross over each other. However, where the intake and exhaust valves are so disposed on opposite sides of the cylinder head, this has generally necessitated the use of separate camshafts for operating the intake and exhaust valves, respectively. Although the use of separate camshafts has certain advantages, it further complicates the engine. Not only does this tend to raise the overall height of the engine due to the positioning of the camshafts, but it also significantly complicates the timing arrangement for driving all of the camshaft from the crankshaft of the engine. Although the use of a single overhead camshaft for operating all of the valves is possible, the previously proposed arrangements of this type have given rise to certain other problems. For example, the placement of such added components as spark plugs and the like become a significant problem in connection with the use of single overhead camshafts for multiple valve engines.

It is, therefore, a still further object of this invention to provide an improved valve actuating arrangement for multiple valve engine that employs only a single camshaft.

It is a further object of this invention to provide a multiple valve engine in which all valves are operated by a single camshaft and wherein the camshaft is so located that it will not interfere with or compromise the placement of other components of the engine such as the spark plugs.

In addition to the problems of component placement when all of the multiple valves of an engine are operated by a single camshaft, there also is a considerable problem in connection with adequate support for the camshaft. That is, where multiple valves are operated by a single camshaft, the operating loads exerted on the camshaft can be quite high. It is, of course, extremely important to support the camshaft in such a way that it will not flex and the valve operation will not be adversely affected.

It is, therefore, a still further object of this invention to provide an improved arrangement for journaling the camshaft of a multiple valve internal combustion engine.

It is a further object of this invention to provide a multiple valve, single camshaft internal combustion engine having an improved arrangement for journaling the single camshaft.

Where multiple valves are operated for an engine from a single camshaft, it is generally the practice to employ some form of rocker arm arrangement for operating the valves from the camshaft so that the valves can be located in the combustion chamber at optimum positions and may reciprocate along the desired axes. However, where rocker arms are employed, it is also necessary to provide an arrangement for pivotally journaling the rocker arms. Although individual rocker arm supports have been proposed, these supports have a tendency of permitting the rocker arm to move transversely or rotate about an axis perpendicular to their normal pivotal axis and can adversely affect high speed performance. Therefore, it is desirable to mount the rocker arms for their pivotal movement on a rocker arm shaft which shaft will tend to maintain the movement of the rocker arm in its desired path. However, the use of the rocker arm shafts can give rise to other problems, particularly in the placement of other components of the engine.

It is, therefore, a still further object of this invention to provide an improved arrangement for supporting the rocker arms of an internal combustion engine.

It is a yet further object of this invention to provide an improved rocker arm shaft arrangement for an internal combustion engine wherein the rocker arm shafts are formed in such a way as to not interfere with access to other components of the engine.

In connection with the use of multiple valves, it is a desirable practice to employ three intake valves for each cylinder of the engine. In order to facilitate operation of the valves and their placement, it has been the practice to place two of these valves, the outermost valves, so they reciprocate about parallel acute axes to a plane containing the cylinder bore axis. The third, middle valve, is disposed outwardly toward the periphery of the cylinder bore from this plane and also reciprocates about an axis that is at an acute angle to the plane but which angle is less than the aforenoted angle. Although this arrangement is particularly useful, the placement of the valve heads previously proposed has been such as to require the formation of a fairly deep recess in the peripheral edge of the piston so as to provide clearance. This can present certain difficulties.

It is, therefore, a still further object of this invention to provide an improved valve placement valve arrangement for a multiple valve engine wherein the volume of clearance areas formed in the peripheral edges of the head of the piston can be minimized.

SUMMARY OF THE INVENTION

A first feature of this invention is adapted to be embodied in a cylinder head for an internal combustion engine that has a lower surface which defines in part a combustion chamber. A first plurality of valves are supported for reciprocation along axes that lie at acute angles on one side of a plane passing generally through the center of the cylinder head. A second plurality of valves reciprocate along axes that lie at acute angles to the plane on the other side thereof. The area of the cylinder head spaced from its lower surface and between the portions supporting the valves define generally a void. A bridging member is formed integrally by the cylinder head and extends across the void and within an area bounded by an extension of the combustion chamber surface for reinforcing the cylinder head.

Another feature of the invention is also adapted to be embodied in a cylinder head assembly for an internal combustion engine. The assembly comprises a cylinder head having a surface defining in part a combustion chamber. A camshaft is rotatable about a camshaft axis that lies in a plane that extends transversely to the combustion chamber. First valve means are supported for reciprocation substantially on one side of the plane and second valve means are supported for reciprocation substantially on the other side of the plane. The valve means all serve the combustion chamber and comprise poppet valves. The number of poppet valves of the first valve means is greater than the number of poppet valves of the second valve means. In accordance with this feature of the invention, the camshaft axis lies closer to the first valve means than to the second valve means.

Another feature of the invention is adapted to be embodied in a camshaft arrangement for a multiple valve internal combustion engine that comprises a cylinder head that is adapted to form in part a combustion chamber. A camshaft is journaled for rotation relative to the cylinder head about a camshaft axis. A first plurality of valves are supported for reciprocation about axes that lie substantially on one side of the camshaft axis and a second plurality of valves are supported for reciprocation about axes lying on the other side of the camshaft axis. Valve actuating means operate all of the valves from the camshaft and this valve actuating means includes at least a pair of cam lobes that are formed on the camshaft. A pair of pivotally supported rocker arms each have a follower portion engaged with a respective one of the pair of cam lobes for pivoting the rocker arm means. Bearing means journal the camshaft for rotation about a bearing surface that is disposed between the cam lobes and adjacent to them.

Yet another feature of the invention is adapted to be embodied in a cylinder head assembly for an internal combustion engine and comprises a cylinder head forming in part a combustion chamber. A plurality of poppet valves are supported for reciprocation by the cylinder head and serve the combustion chamber. A camshaft is provided and bearing cap means are affixed to the cylinder head and journal the camshaft with the cylinder head for rotation about a camshaft axis. At least one rocker arm is supported for pivotal movement upon a rocker arm shaft carried by the bearing cap means. An opening is formed in the bearing cap means and is aligned with an opening in the cylinder head for passage of a component fixed at least to the cylinder head. The bearing cap opening passes across an area where the rocker arm shaft extends and the rocker arm shaft is formed with a relief in the area of the opening to pass the component with a clearance.

Yet another feature of the invention is adapted to be embodied in a cylinder head assembly for cooperation with a cylinder bore to form a combustion chamber. The cylinder head assembly supports three poppet valves for reciprocation. A first two of these poppet valves reciprocate about parallel axes that are inclined at an acute angle to a plane containing the axis of the cylinder bore. The third of these valves also reciprocates about an axis that is disposed at an acute angle to this plane but at a lesser acute angle than the angle of reciprocation by the first two valves. The third valve is disposed further from the plane and in their closed positions, the edge of the head of the third valve is disposed at a point that is not lower than the adjacent portions of the heads of the first two valves toward the cylinder bore.

DETAILED DESCRIPTION OF THE PREFERRED EMBODIMENTS

Figure 1:
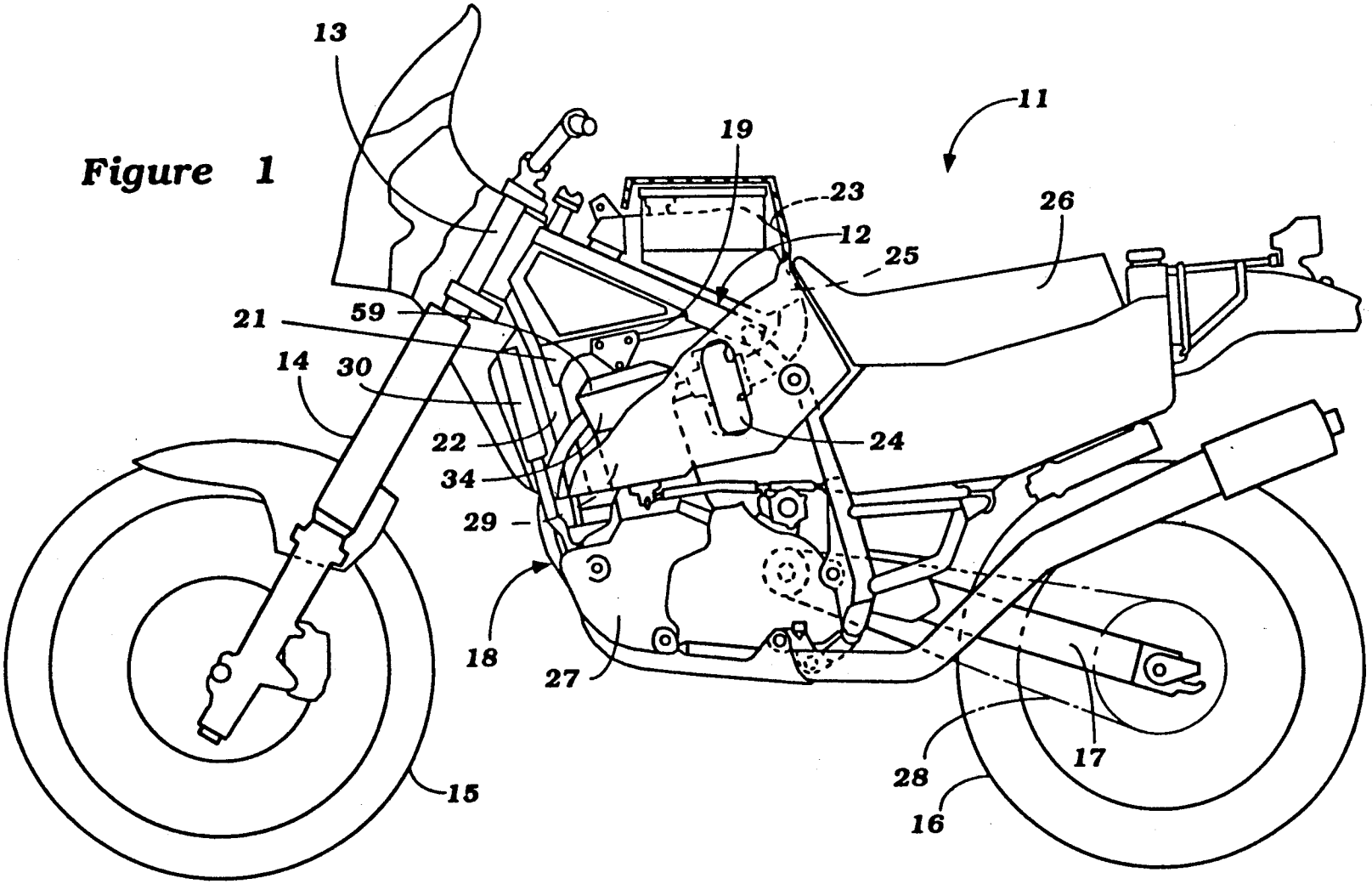
FIG. 1 is a side elevational view of a motorcycle powered by an internal combustion engine constructed in accordance with an embodiment of the invention, with a portion broken away and shown in section.

Referring first to FIG. 1, a motorcycle powered by an internal combustion engine constructed in accordance with an embodiment of the invention is identified generally by the reference numeral 11. The motorcycle 11 is depicted as a typical environment in which an engine embodying the invention may be employed. The invention has particular utility in conjunction with internal combustion engines used to power vehicles. However, it will be readily apparent to those skilled in the art that the invention may be practiced in conjunction with other engine applications.

The motorcycle 11 is comprised of a frame assembly, indicated generally by the reference numeral 12, and which is of the welded up type including a head pipe 13 that journals a front fork assembly 14 for steering movement and which supports a front wheel 15 in a known manner. In a similar manner, a rear wheel 16 is supported by the frame assembly 12 by means including a trailing arm suspension 17.

Figure 2:
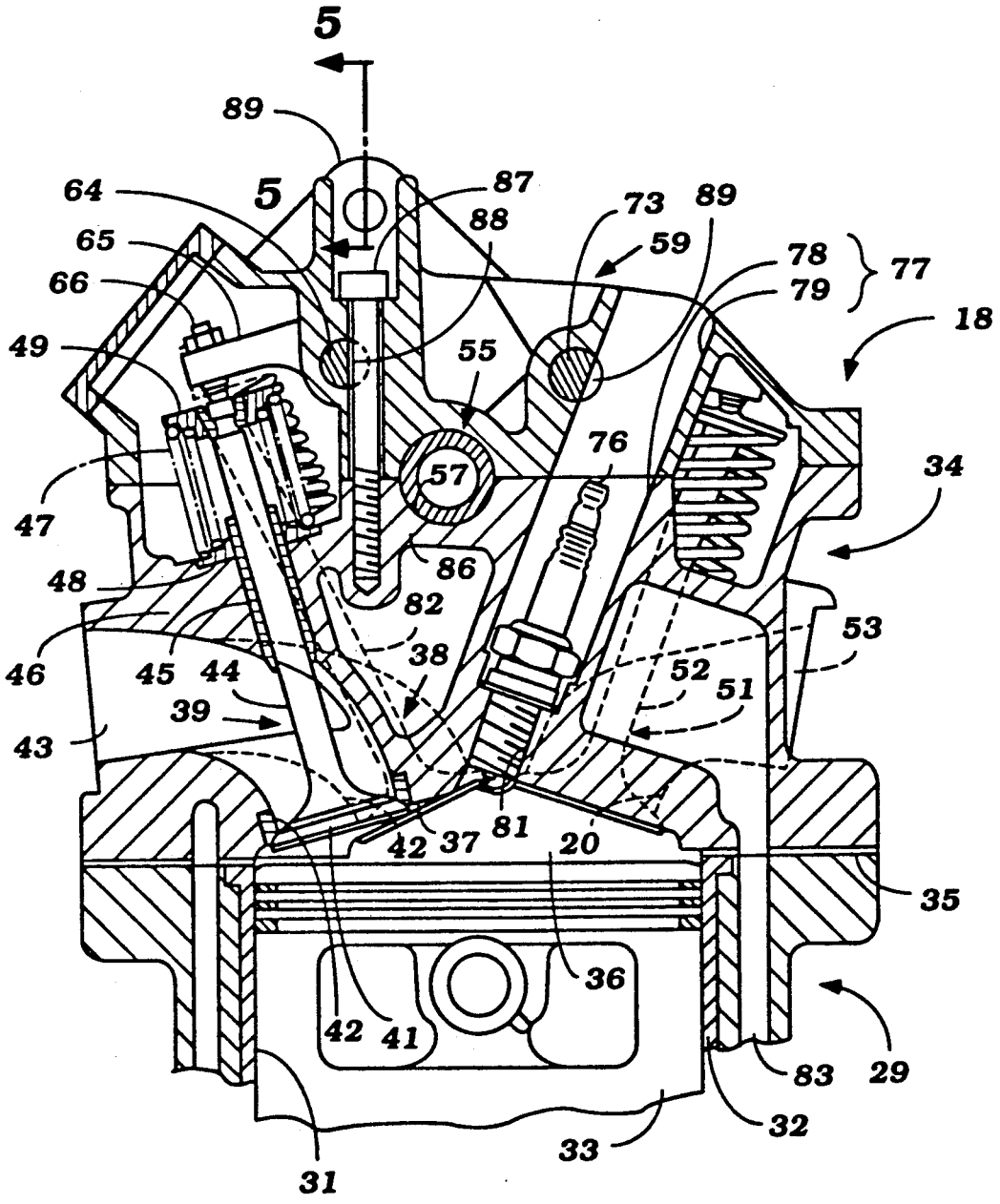
FIG. 2 is a cross-sectional view showing the top portion of the engine in cross-section taken along the line 2—2 of FIG. 3.
Figure 3:
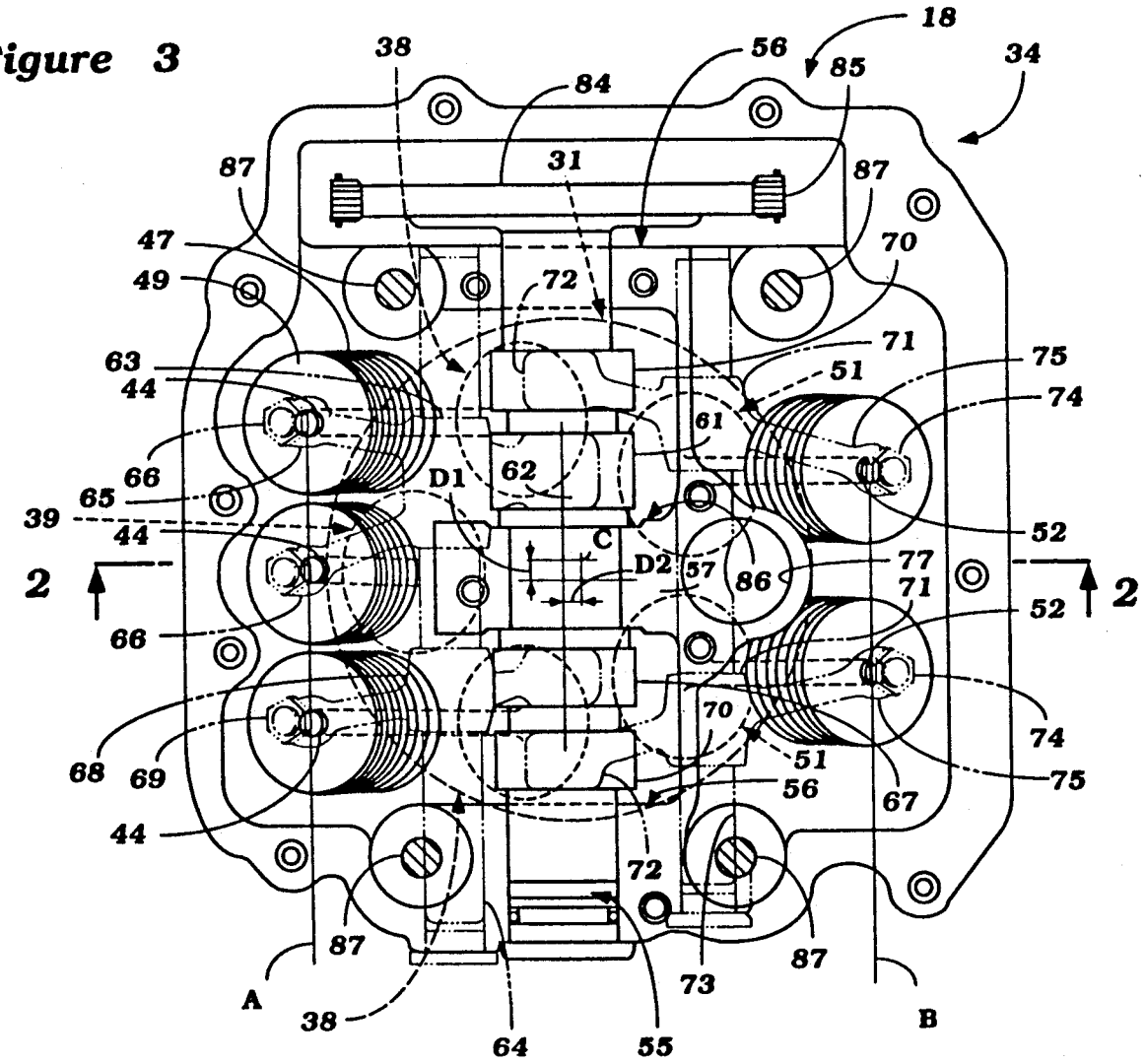
FIG. 3 is a top plan view of the cylinder head assembly with the cam cover removed but with components carried by it shown in phantom.
Figure 4:
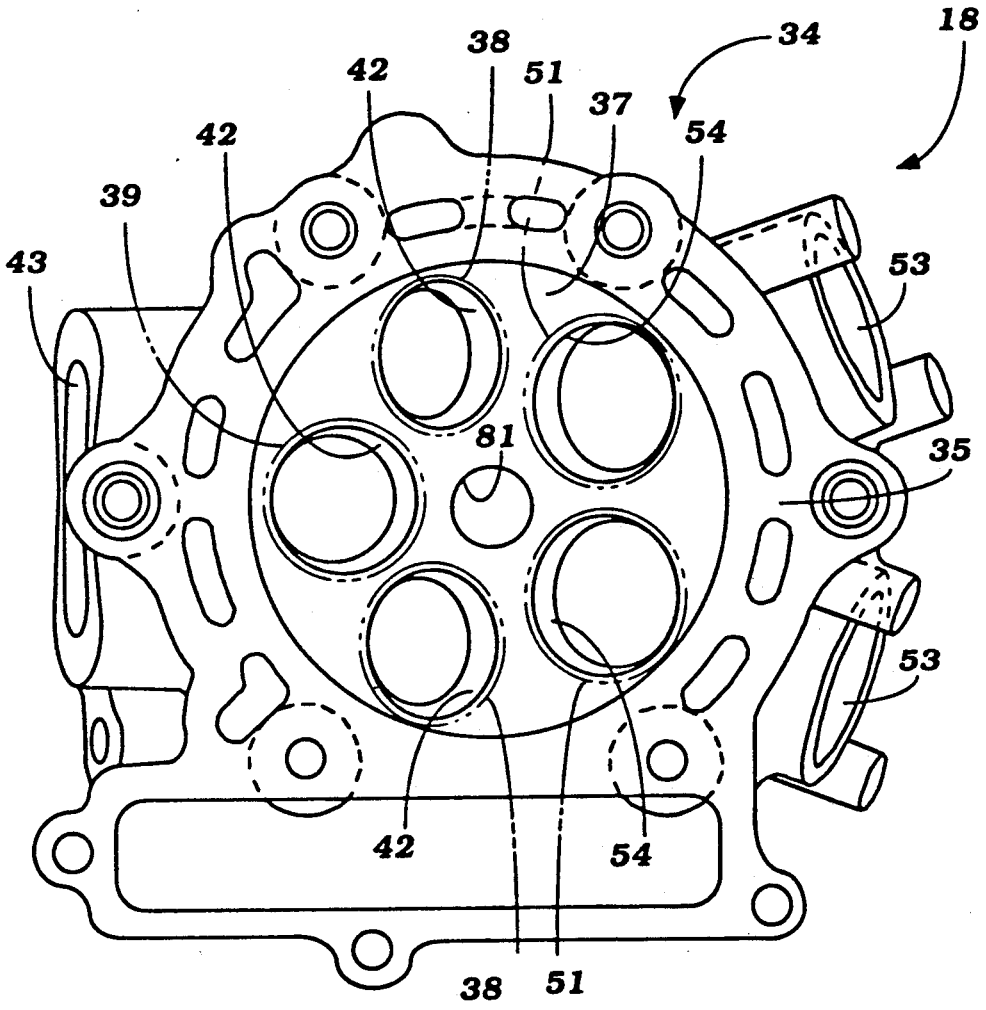
FIG. 4 is a bottom plan view showing the cylinder head assembly, with the intake and exhaust valves being depicted in phantom.
Figure 5:
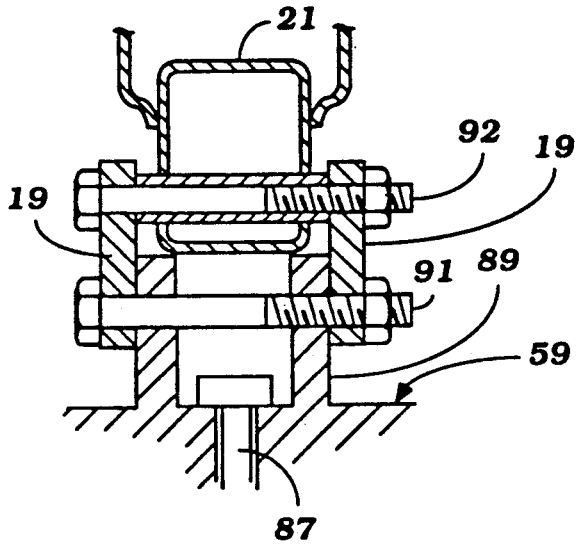
FIG. 5 is a cross-sectional view taken along the line 5—5 of FIG. 2 and shows the engine mounting arrangement.
Figure 6:
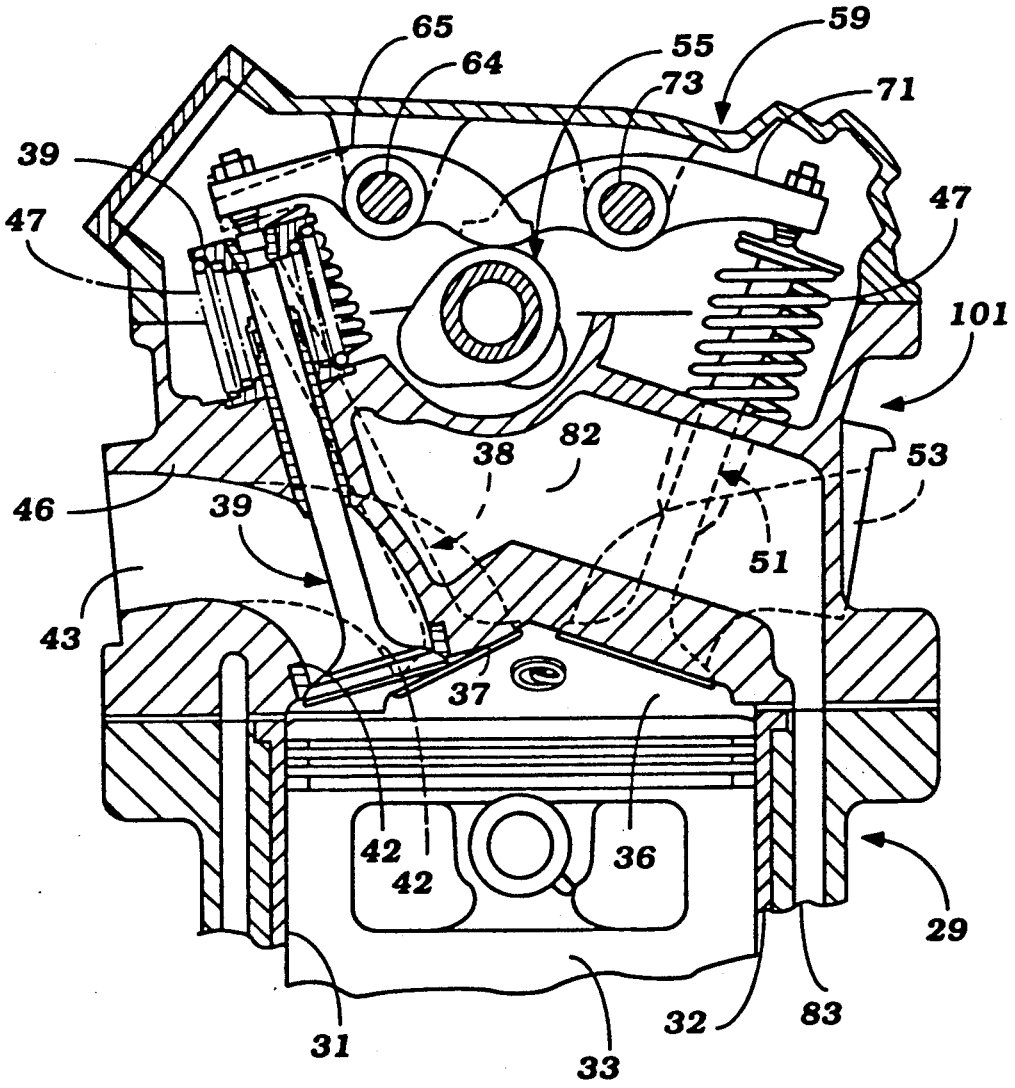
FIG. 6 is a cross-sectional view, in part similar to FIG. 2, and shows another embodiment of the invention. This view is taken generally along the line 6—6 of FIG. 7.

An internal combustion engine, indicated generally by the reference numeral 18 and shown in more details in FIGS. 2 through 4, is supported within the frame assembly 12 by means including an engine mount 19 that is affixed to a gusset plate 21 which is affixed to or forms a part of the frame assembly 12 in a manner as will be later described by reference to FIG. 5. The engine 18 is further supported in a suitable manner from a down tube 22 of the frame 12.

A fuel tank 23 is supported by the frame 12 above the engine 18 and supplies fuel to the engine in a known manner and specifically to carburetors 24 thereof. An air cleaner 25 supplies filtered air to the carburetors 24.

A seat 26 is supported on the rear of the frame assembly 12 behind the fuel tank 23 so as to accommodate a rider.

The engine 18, as is common with motorcycle practice, includes an integral crankcase, change speed transmission assembly 27 that drives the rear wheel 16 through a chain 28 in a known manner.

The engine 18 or at least portions of it are water cooled and for this purpose there is mounted a radiator 30 on the frame assembly 12 forwardly of the down tube 22. The construction of the motorcycle and its drive arrangement as thus far described may be considered to be conventional and, for that reason, further description of the motorcycle per se is not believed to be necessary to understand the construction and operation of the invention.

Referring now in detail to FIGS. 2 through 4, the construction of the engine 18 will be described in detail. Since the invention relates primarily to the cylinder head assembly and particularly the camshaft support and the valve actuating mechanism, only the top portion of the engine assembly has been depicted and will be described in conjunction with a single cylinder of the engine. In the illustrated embodiment, the engine is of the single cylinder type but it is to be understood that the invention can be practiced in combination with multiple cylinder engines and the adoption of the invention to such engines is believed to be well within the scope of those skilled in the art in view of the following description. Two such multi-cylinder embodiments will also be described by reference to FIGS. 9 and 10 and FIG. 11.

The engine 18 is comprised of a cylinder block assembly 29 that defines one or more cylinder bores 31 by means of pressed in or otherwise inserted liners 32. A piston 33 is supported for recpirocation within the cylinder bore 31 and is connected by means of a connecting rod (not shown) to a crankshaft for driving it in a known manner.

A cylinder head assembly, indicated generally by the reference numeral 34, is affixed to the cylinder block 29 in a known manner and has a downwardly facing sealing surface 35 that is adapted to cooperate with a gasket (not shown) interposed between this surface and a corresponding upper surface of the cylinder block 29 for sealing purposes. Centrally of the sealing surface 35, the cylinder block is provided with a combustion chamber area 36 that is defined by a recess 37 of the cylinder head 34, the head of the piston 33 and cylinder bore 31. The volume of the chamber 36 varies, of course, with the reciprocation of the piston 33 and is shown in FIG. 2 at its top dead center position.

In order to permit an intake charge to be delivered to the combustion chamber 36, there is provided a multiple intake valve assembly which lies generally on one side of a plane containing the axis C of the cylinder bore 31 (FIG. 3) and which extends perpendicularly to the plane of FIG. 2. This intake valve assembly includes a pair of intake valves 38 which are supported for reciprocation about parallel axes that are disposed at an acute angle to the aforenoted plane.

There is provided a further intake valve 39 that is supported by the cylinder head assembly 34 for reciprocation about an acute angle to the aforenoted plane but which angle is different than the angle of the intake valves 38. The disposition of the intake valves 38 and 39 is generally as set forth in U.S. Pat. No. 4,660,529, entitled "Four Cycle Engine", issued Apr. 28, 1987 and assigned to the assignee of this application except as will be hereinafter noted. The disclosure of that application for the particular valve orientation and the advantages of it is incorporated herein by reference.

Each of the intake valves 38 and 39 is formed with a head portion 41 that cooperates with a respective valve seat 42 that is pressed into the cylinder head assembly 34 in a known manner. These valve seats are formed at the termination of an intake port 43 that extends through one side of the cylinder head assembly 34 from a single inlet as best shown in FIG. 3 and which terminates at the individual valve seats 42.

Each of the valves 38 and 39 further has a stem portion 44 that is supported for reciprocation within a respective guide 45 formed in a portion 46 of the cylinder head 34. The angular disposition of the stems 44 is such that the tips thereof all lie on a line A as seen in FIG. 3 when the valves 39 and 39 are closed.

The valves 38 and 39 are urged toward their closed positions by means of coil compression spring assemblies 47 that bear at their lower ends against a bearing plate 48 engaged with the cylinder head 34 or formed on the respective valve guide 45 and at their upper ends with a spring retainer 49 that is held to the stem 44 of the respective valve by a keeper assembly of a known type.

The valve placement shown in U.S. Pat. No. 4,660,529 is such that the head of the intake valve 39, which is disposed furthest from the plane containing the cylinder bore axis, has the tip or toe portion of it disposed lower than or at the same point as the adjacent portions of the valves 38. At a result of this, it may be necessary to form a recess in the head of the piston 33 for clearance purposes. In accordance with a feature of this invention, the head 41 of this outermost valve 39 is raised so that its toe portion does not extend below the heads 41 of the valves 38 as may be clearly seen in FIG. 2. As a result, a lesser recessed area is necessary in the head of the piston 33 for clearance purposes.

On the opposite side of the aforenoted plane, there are supported in the cylinder head assembly 34 a pair of exhaust valves 51 which have stem portions 52 that are reciprocally supported in the cylinder head assembly 34 by valve guides of the type aforedescribed. The valve stems 52 reciprocate about parallel axes which are disposed at an acute angle to the aforenoted plane and which acute angle is less than the acute angle of the pair of intake valves 38 and greater than the acute angle of the intake valve 39. The tips of the stems 52 lie along a line B (FIG. 3) when the exhaust valves 51 are closed. These exhaust valves 51 control the flow of exhaust gases from the combustion chamber to respective exhaust ports 53 formed in the side of the cylinder head 34 opposite the intake passage 43. The valves 51 cooperate with valve seats 54 in a known manner so as to control this flow.

All of the intake valves 38 and 39 and both of the exhaust valves 51 are operated by means of a single overhead camshaft 55. The camshaft 55 is journaled, in a manner to be described, for rotation about a camshaft axis that extends parallel to the aforenoted plane and which is offset slightly from one side thereof and the cylinder bore axis C by the distance D2 toward the intake valves 38 and 39. However, the axes of reciprocation of the intake valves 38 and 39 all lie on one side of a plane containing the axis of rotation of the camshaft 55 while the axes of reciprocation of the exhaust valves 51 lies on the other side of this plane.

The camshaft 55, since it operates all of the valves 38, 39 and 51, must be very rigidly supported so as to resist any bending forces on it. To that end, the camshaft 55 is provided with spaced bearing portions adjacent its ends which are journaled within bearing surfaces 56 formed by the cylinder head 34. In addition, there is provided a central bearing portion on the camshaft inwardly of its ends that is journaled on a bearing surfaces 57 of the cylinder head assembly 34. The center of this camshaft bearing surface and the cylinder head bearing surface is offset a distance D1 from the cylinder bore axis C. The bearing surfaces 56 and 57 of the cylinder head cooperate with corresponding bearing surfaces formed by a combined bearing cap and cam cover assembly, indicated generally by the reference numeral 59 and which is affixed to the cylinder head 34 in a manner to be described.

One of the intake valves 38 and the intake valve 39 are operated by a single intake lobe 61 of the cam shaft 52, which lobe 61 is disposed between the bearing surfaces of the camshaft which cooperate with the cylinder head bearing surfaces 56 and 57 and the corresponding bearing portions of the cam cover, bearing cap 59. As a result, the construction is extremely rigid.

The cam lobe 61 cooperates with a follower portion 62 of a first intake rocker arm 63 that is journaled in the cam cover, bearing cap 59 on a rocker arm shaft 64. The rocker arm shaft 64 is journaled in a suitable manner in the cover 59. The rocker arm 63 has two extending arm portions 65. The portions 65 carry adjusting screws 66 that cooperate with the tips of the stem of one of the pair of intake valves 38 and the tip of the stem at the valve 39 so as to operate these valves.

The camshaft 55 is provided with a further cam lobe 67 that is disposed on the opposite side of the central bearing portion of the camshaft which cooperates with the cylinder head bearing surface 57 from the cam lobe 61. The cam lobe 67 is located between the bearing surfaces 55 and 56 and cooperates with a second intake rocker arm 68 that is also journaled on the rocker arm shaft 64. The rocker arm 68 is a single rocker arm and carries an adjusting screw 69 for operating the remaining valve of the intake valve pair 38.

The camshaft 55 is also provided with a pair of exhaust lobes 70 which lobes are each disposed between a respective one of the end bearing surfaces on the camshaft and the intake lobes 61 and 67. A pair of exhaust rocker arms, indicated generally by the reference numerals 71 each have follower portions 72 that cooperate with a respective of the exhaust cam lobes 70 for pivoting the rocker arms 71 about a rocker arm shaft 73 which, like the rocker arm shaft 64, is carried by the cam cover and bearing cap 59. Adjusting screws 74 carried at the outer ends 75 of the rocker arms 71 contact the tips of the exhaust valve stems 52 for operating the exhaust valves in a known manner.

The engine is also provided with a spark plug 76 for firing the charge in the combustion chamber 37. The spark plug 76 is received within a spark plug receiving recess 77 formed by aligned bores 78 and 79 formed in the cylinder head 34 and cam cover 59, respectively. A tapped hole 81 formed at the bottom of the cylinder head bore 78 receives the threads of the spark plug so that its gap will be positioned generally centrally of the combustion chamber 37.

The cylinder head 34 is also provided with a cooling jacket 82 through which coolant is circulated from a cooling jacket 83 of the cylinder block 29 in a manner described in my copending application entitled "Cylinder Head Cooling For Multiple Valve Engine", Serial No. 357,473, filed May 26, 1989, and assigned to the assignee of this application now issued as U.S. Pat. No. 4,972,807 on Nov. 27, 1990.

The camshaft 55 carries a sprocket 84 at one end which is driven at one-half crankshaft speed by a chain 85.

It should be noted that the provision of the cooling cavity 82 gives the cylinder head 34 a generally open V-type configuration. However, in accordance with the invention, there is provided a bridging member 86 that extends across the upper portion of the cooling cavity 82 and which serves as a bridging portion between the opposite sides of the cylinder head to additionally provide the bearing surface 57 for the center bearing portion of the camshaft 55. This bridging portion 86 also extends into the spark plug well 77 so as to provide good reinforcing for the cylinder head in this area. As a result of the use of this bridging member, which extends substantially across the center portion of the combustion chamber 36, the cylinder head will be quite strong.

As may be seen in FIGS. 2 and 3, the bearing cap, cam cover 59 is held to the cylinder head 34 by means of four spaced bolts 87. Certain of the bolts 87 extends through areas where the rocker arm shafts 67 and 73 also extend. In order to prevent interference, the rocker arm shafts are relieved in these areas as seen at 88 in FIG. 2. In like manner, the exhaust rocker arm shaft 73 extends through the spark plug recess 77 and to prevent interference, a portion 89 of this rocker arm shaft is removed or relieved so as to permit the spark plug 76 to be inserted and removed without interference. As a result, the construction can be extremely compact and yet there is no sacrifice made for the good operation of the components or the ability to service them.

Figure 7:
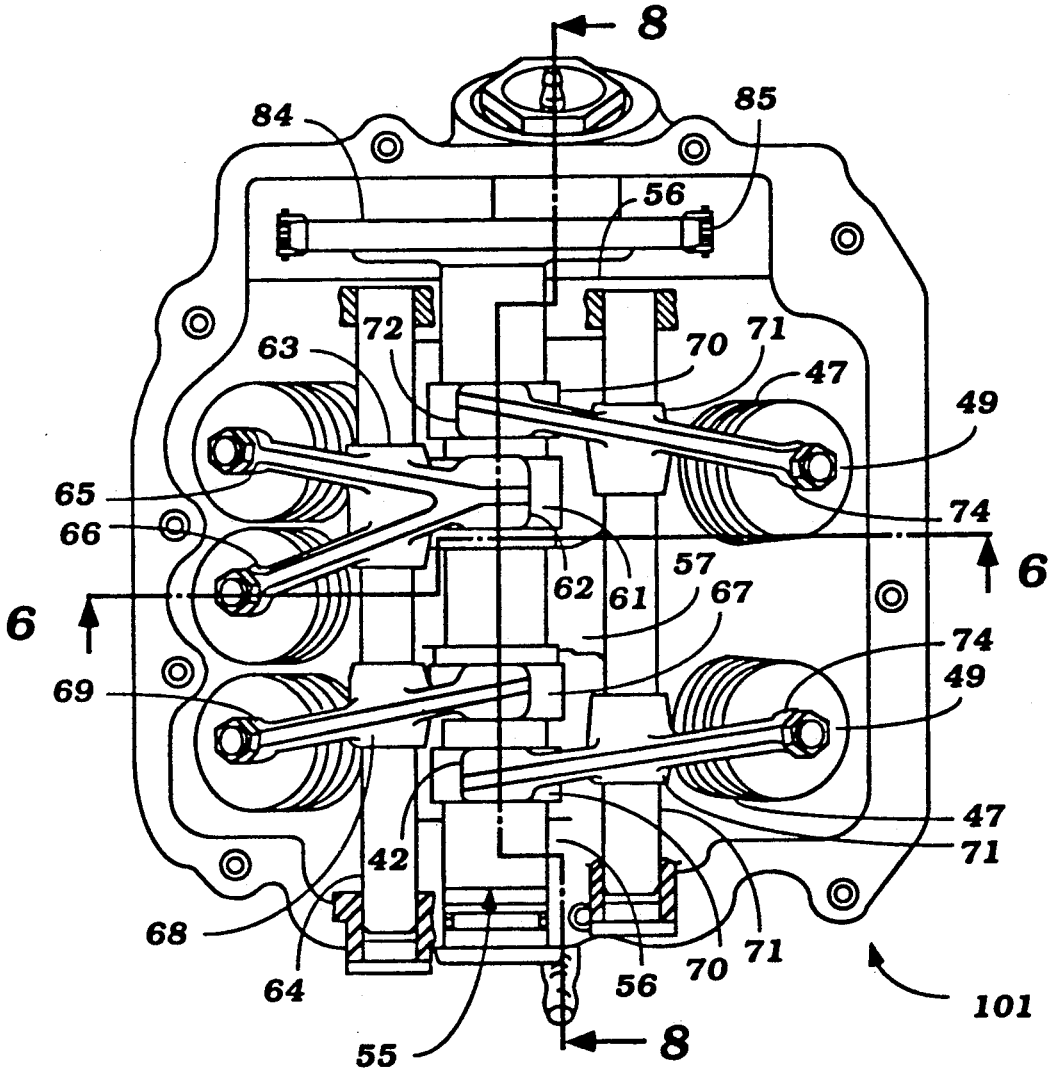
FIG. 7 is a top plan view of the cylinder head of this embodiment with the cam cover partially removed.

Referring now primarily to FIGS. 2 and 7, it will be seen that the bearing cap, cam cover 59 is provided with an upwardly extending lug portion 89 which is generally bifurcated to pass one of the hold-down bolts 87. This bifurcated lug 89 is formed with a pair of aligned bores through which a first bolt and nut assembly 91 extends so as to attach a pair of engine mounts 19 to the engine. A second bolt and nut assembly 92 passes through another series of holes in the engine mounts 19 so as to secure the engine mounts 19 and engine to the frame cross member or gusset 21, as aforedescribed.

In the embodiment of the invention as thus far described, the engine has been provided with a single spark plug for each cylinder or combustion chamber. Such an arrangement has particular utility; however, in large bore engines, it may be desirable to employ plural, such as two spark plugs. The use of plural spark plugs is advantageous to insure that the entire charge in the cylinder will be burned even under high speed running. By using multiple spark plugs, it is possible to insure that this result is obtained.

Figure 8:
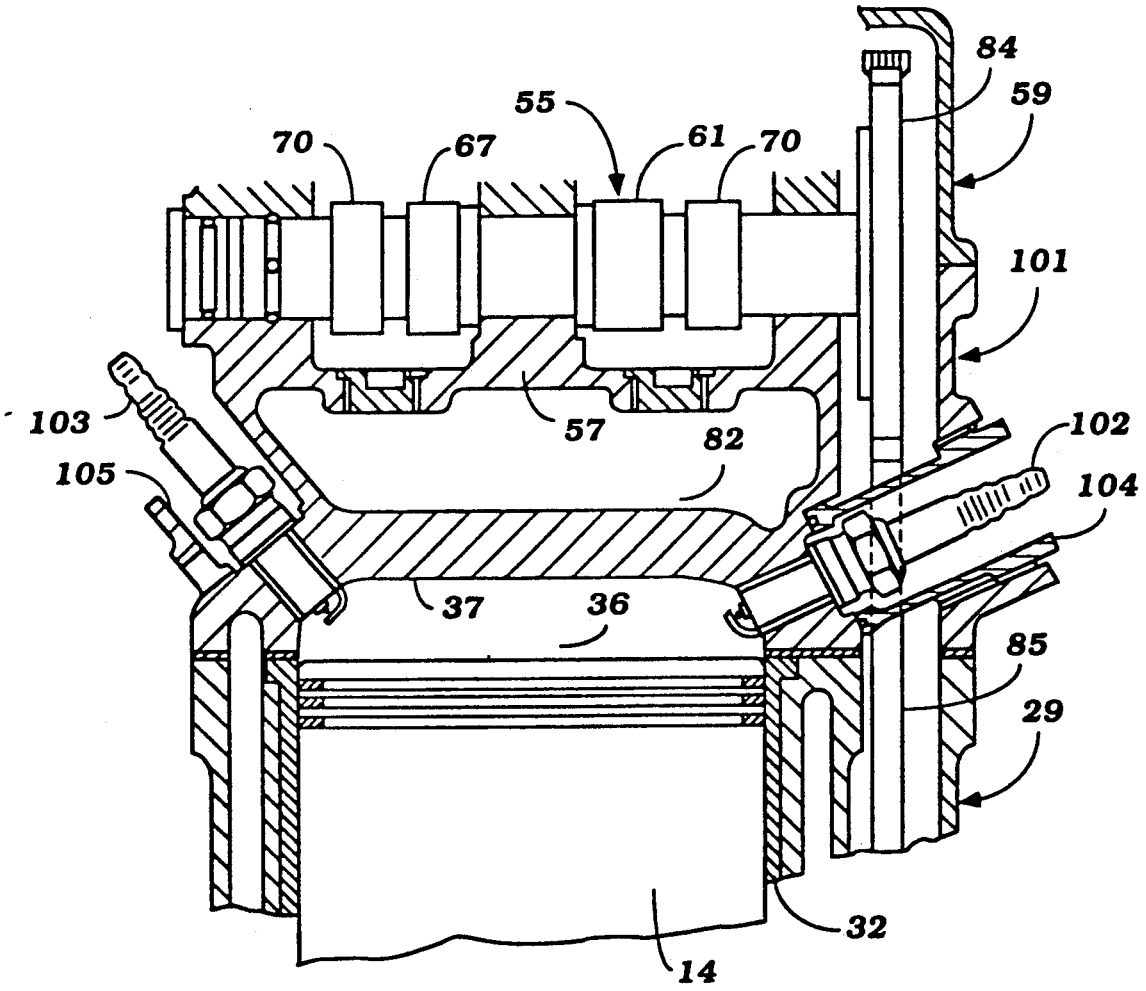
FIG. 8 is a cross-sectional view of this embodiment and is taken along the line 8—8 in FIG. 7.

The invention, however, can be utilized in conjunction with engines having two spark plugs per cylinder and such an embodiment is shown in FIG. 8 wherein the engine is identified generally by the reference numeral 101. Except for the use of the two spark plugs and the construction in the cylinder head for accommodating them, this embodiment is the same as the previously described embodiment. For that reason, components which are the same as those of the previously described embodiment have been identified by the same reference numerals and will be described again only insofar as is necessary to understand the construction and operation of this embodiment.

In this embodiment, there are provided two diametrically positioned spark plugs 102 and 103. The spark plug 102 is positioned in a spark plug recess 104 that is formed in the timing cover portion of the engine and passes between the flights of the drive chain 85. The spark plug 103, on the other hand, is disposed beyond the end of the camshaft 55 and is provided within a spark plug well 105 formed in this portion of the cylinder head. In all other regards, this embodiment is the same as the previously described embodiment, and for that reason further description of it is believed to be unnecessary to permit those skilled in the art to practice the invention.

In this embodiment, the bridging member 86 does not extend to the spark plug recess 77 because of the different placement of the spark plugs. However, the bridging member 86 still acts to reinforce the cylinder head as in the previously described embodiment.

Figure 9:
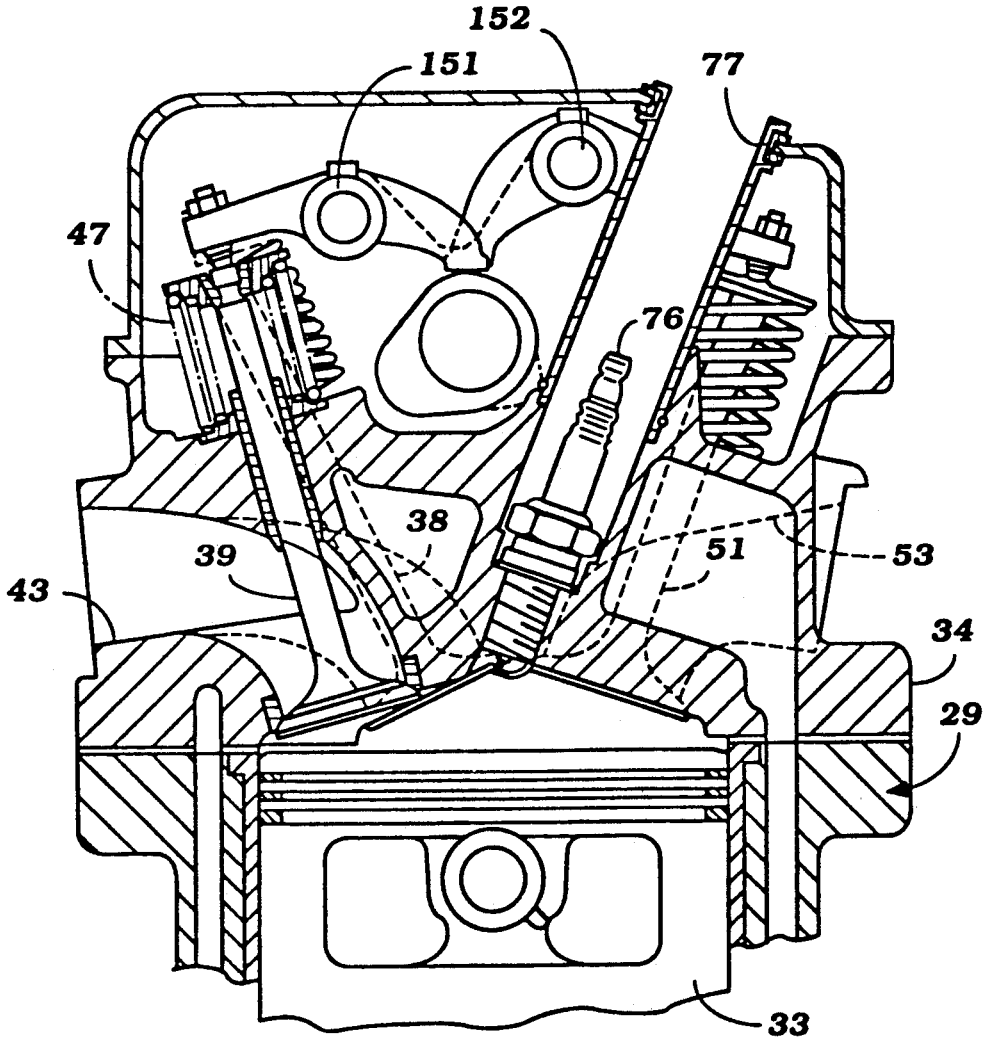
FIG. 9 is a cross-sectional view, in part similar to FIGS. 2 and 6, and shows yet another embodiment of the invention.
Figure 10:
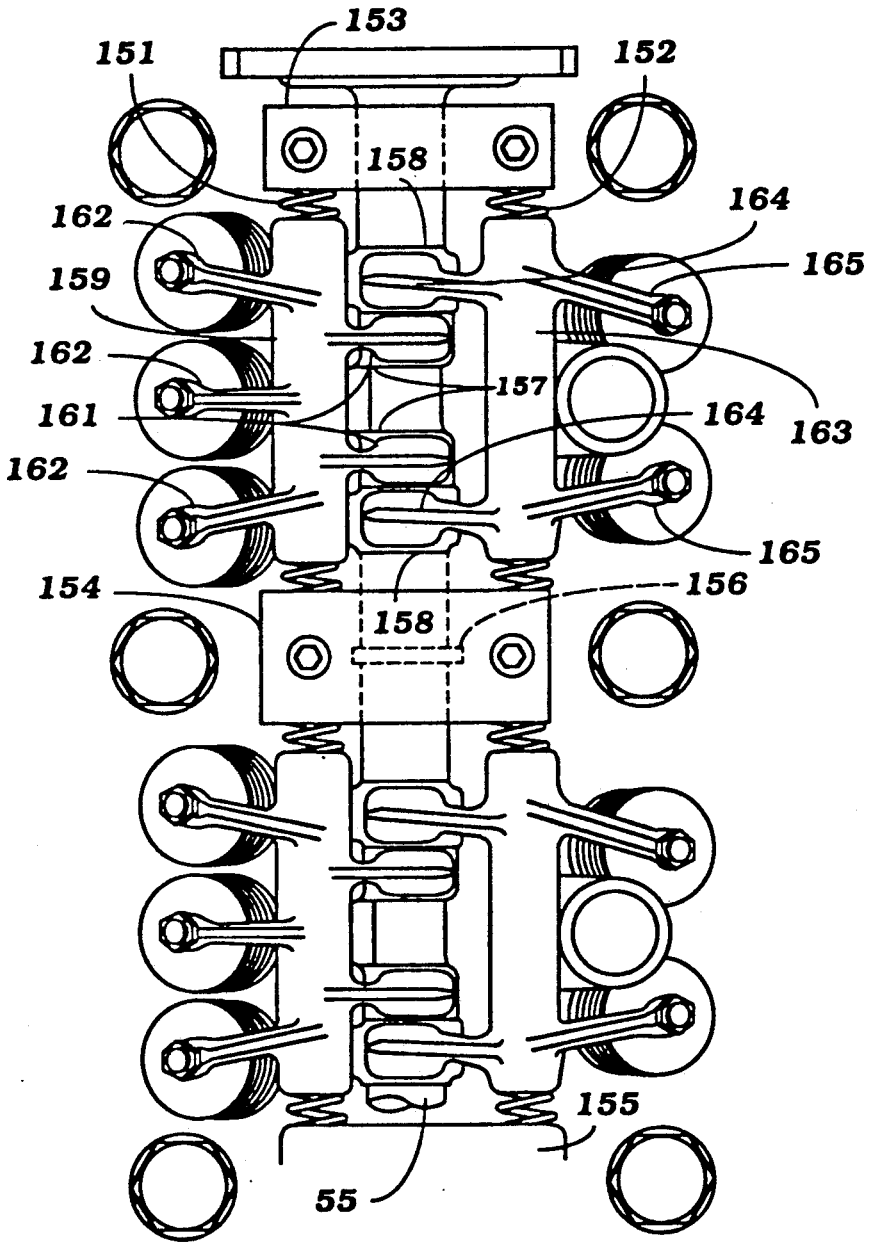
FIG. 10 is a top plan view of the embodiment of FIG. 9 with the cam cover removed.

In the embodiments of the invention as thus far described, the invention has been described in relation to a single cylinder engine. As has been previously noted, the invention is adaptable of use in multiple cylinder engines and one such embodiment is shown in FIGS. 9 and 10. Because this embodiment is generally similar to the previously described embodiments, those components which are the same or substantially the same have been identified by the same reference numerals and will not be described again in detail.

In this embodiment, an intake rocker arm shaft 151 and exhaust rocker arm shaft 152 are supported and journaled by means of bearing caps 153, 154 and 155 which are affixed to the cylinder head 34 in a conventional manner. As a result, the exhaust rocker arm shaft 152 can be positioned more inwardly from the spark plug recess 77 and it is not necessary to relieve the exhaust rocker arm shaft 152 for this reason. In a like manner, in this embodiment, the camshaft 55 is provided with spaced bearing portions that are journaled in the bearing caps 153, 154 and 155 in a more conventional manner. The camshaft 55 is provided with a thrust shoulder 156 that cooperates with thrust taking surfaces of the bearing cap 154 so as to take axial thrusts on the camshaft 55.

For each cylinder of the engine, the camshaft 55 is provided with a pair of intake lobes 157 that are disposed generally adjacent each other and a pair of exhaust lobes 158 that are disposed ouwardly of the intake lobes 157. A single intake rocker arm 159 for each cylinder has a pair of follower portions 161 that engage the intake cam lobes 157. The rocker arm 159 also has three extending arm portions 162, each of which operates a respective one of the intake valves.

In a similar manner, there is provided a single exhaust rocker arm 163 that has a pair of follower portions 164 that are engaged with the exhaust cam lobes 158. This rocker arm also has a pair of finger portions 165 that carry adjusting screws that cooperate with the exhaust valve stems to actuate them. In all other regards, this embodiment is the same as those previously described.

Figure 11:
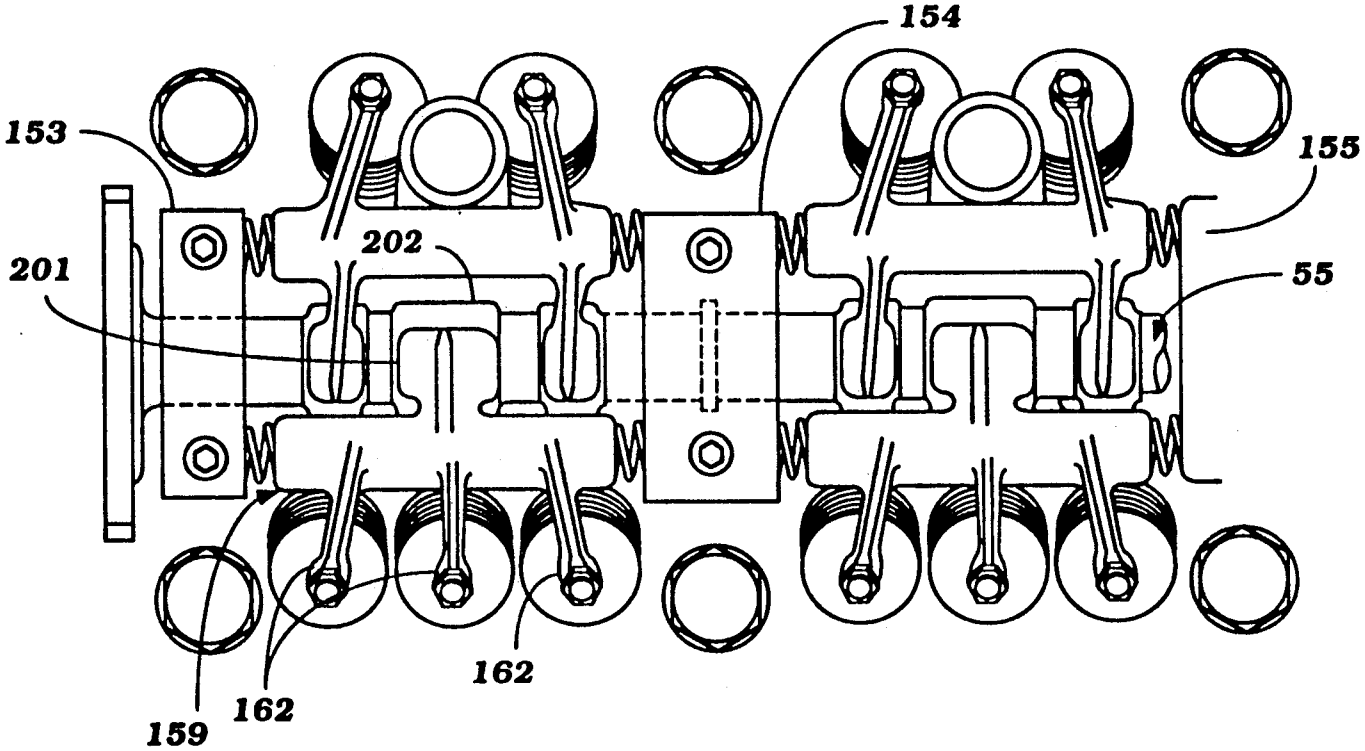
FIG. 11 is a top plan- view, in part similar to FIG. 10, showing yet another embodiment of the invention.

FIG. 11 shows yet another embodiment of the invention which is generally similar to the embodiment of FIGS. 9 and 10 and which can be utilized in conjunction with a multiple cylinder engine. This embodiment differs from the embodment of FIGS. 9 and 10 only in that the rocker arms associated with the intake valves only have a single follower portion 201 that is engaged with a single cam lobe 202 on the camshaft 55 for operating the intake valves 38 and 39. In all other regards, this embodiment is the same as previously described embodiment and those components which are the same or substantially the same have been identified by the same reference numerals and further description of them and of this embodiment is not believed necessary to enable those skilled in the art to make and use the invention.

It should be readily apparent from the foregoing description that a number of embodiments of multiple valve, single overhead camshaft engines have been described, each of which is effective in achieving the goals of the invention as aforenoted. Although a number of embodiments of the invention have been illustrated and described, various changes and modifications may be made without departing from the spirit and scope of the invention, as defined by the appended claims.

I claim:

1. A cylinder head assembly for an internal combustion engine and adapted to be affixed in closing relation to a cylinder bore formed in an associated cylinder block, said assembly comprising a cylinder head having a surface defining in part a combustion chamber with the cylinder bore, a camshaft rotatable about a camshaft axis lying in a plane that extends transversely to said combustion chamber and said cylinder bore, first valve means supported for reciprocation substantially on one side of said plane, second valve means supported for reciprocation substantially on the other side of said plane, said valve means all serving said combustion chamber, said valve means comprising poppet valves, the number of poppet valves of said first valve means being greater than the number of poppet valves of said second valve means, said camshaft having a bearing surface lying within a projection of said cylinder bore, said bearing surface of said camshaft being offset from the center of said cylinder bore toward one end of said engine, means for journaling said bearing surface in said cylinder head assembly for rotation about said camshaft axis, and means for operating said valve means from said camshaft.

2. A cylinder head assembly as set forth in claim 1 further including a pair of cam lobes formed on the camshaft on opposite sides of the bearing surface.

3. A cylinder head assembly as set forth in claim 2 wherein the pair of cam lobes operate the first valve means.

4. A cylinder head assembly as set forth in claim 3 further including rocker arm means operated by the cam lobes for operating the first valve means.

5. A cylinder head assembly as set forth in claim 4 wherein the rocker arm means includes at least two rocker arms.

6. A cylinder head assembly as set forth in claim 5 wherein the rocker arms are pivotally supported upon a rocker arm shaft and wherein the cylinder head is formed with a recess for passing a member affixed to the cylinder head and wherein the rocker arm shaft passes across the recess and has a relief portion so that the member can be freely inserted into and removed from the recess.

7. A cylinder head assembly as set forth in claim 1 wherein the valve means are operated by cam lobes formed on the camshaft on opposite sides of the bearing surface of the camshaft.

8. A cylinder head assembly as set forth in claim 7 wherein the cam lobes comprise a first pair of cam lobes that operate the valves of the first valve means.

9. A cylinder head assembly as set forth in claim 8 further including rocker arm means operated by the first pair of cam lobe for operating the first valve means.

10. A cylinder head assembly as set forth in claim 9 wherein the rocker arm means includes at least two rocker arms.

11. A cylinder head assembly as set forth in claim 10 wherein the rocker arms are pivotally supported upon a rocker arm shaft and wherein the cylinder head is formed with a recess for passing a member affixed to the cylinder head and wherein the rocker arm shaft passes across the recess and has a relief portion so that the member can be freely inserted into and removed from the recess.

12. A cylinder head assembly as set forth in claim 11 wherein the member comprises a fastener for securing a cam cover to the cylinder head.

13. A cylinder head assembly as set forth in claim 12 wherein the cam cover carries the rocker arm shaft.

14. A cylinder head assembly as set forth in claim 10 wherein three are three poppet valves of the first valve means.

15. A cylinder head assembly as set forth in claim 14 wherein there are two rocker arms and one of the rocker arms operates one of the valves of the first valve means and the other of the rocker arms is bifurated and operates the remaining two poppet valves of the first valve means.

16. A cylinder head assembly as set forth in claim 9 further including a second pair of cam lobes for operating the second valve means.

17. A cylinder head assembly as set forth in claim 16 wherein there are second rocker arm means operated by the second pair of cam lobes for operating the second valve means.

18. A cylinder head assembly as set forth in claim 17 wherein the rocker arm means that operate the first valve means are pivotally supported on a first rocker arm shaft and the second rocker arm means for operating the second valve means are pivotally supported on a second rocker arm shaft.

19. A cylinder head assembly as set forth in claim 18 wherein the rocker arm shafts are positioned at different distances from the cylinder head surface that closes the cylinder bore.

20. A cylinder head assembly for an internal combustion engine comprising a cylinder head forming in part a combustion chamber, a plurality of poppet valves supported for reciprocation and serving said combustion chamber, a camshaft, bearing cap means affixed relative to said cylinder head and with said cylinder head journaling said camshaft for rotation about a camshaft axis, at least one rocker arm supported for pivotal movement upon a rocker arm shaft carried by said bearing cap means, an opening formed in said bearing cap means and aligned with an opening formed in said cylinder head for passing a component fixed to said cylinder head, said bearing cap opening passing across an area where said rocker arm shaft extends, said rocker arm shaft being formed with a relief in the area of said opening to pass a component with a clearance.

21. A cylinder head assembly as set forth in claim 20 wherein the component comprises a spark plug.

22. A cylinder head assembly as set forth in claim 20 wherein the component comprises a fastener for affixing the bearing cap to the cylinder head.

23. A cylinder head arrangement for closing the bore of an internal combustion engine comprising a first pair of poppet valves supported by said cylinder head for reciprocation about parallel axes that extend at an acute angle to one side of a plane containing the axis of the cylinder bore, a third poppet valve supported for reciprocation by said cylinder head along an axis disposed at an acute angle to said plane, the angle of reciprocation of said third valve being less than the angle of reciprocation of said first pair of valves, said third valve being positioned at a greater distance from said plane than said first pair of valves and having the portion of its head closest to said plane being disposed at a higher position relative to the associated cylinder bore than the heads of the first pair of valves.

24. A cylinder head assembly for an internal combustion engine comprising three poppet valves reciprocally supported in said cylinder head and disposed on one side thereof, a cam shaft rotatably journaled on said cylinder head, first and second rocker arm means operated by said camshaft for operating said poppet valves, said first rocker arm operating one of said poppet valves and said second rocker arm being bifurcated and operating said second and said third poppet valves.

25. A cylinder head assembly as set forth in claim 24 further including fourth and fifth poppet valves reciprocally supported by said cylinder head on the other side of said camshaft from said first, second and third valves and operated from said camshaft by a second pair of rocker arms.

26. A cylinder head assembly as set forth in claim 25 wherein the first rocker arms are pivotally supported on a first rocker arm shaft and the second rocker arms are pivotally supported on a second rocker arm shaft.

27. A cylinder head assembly as set forth in claim 26 wherein the first rocker arm shaft is positioned at a different distance from the associated cylinder block than the second rocker arm shaft.

28. A cylinder head assembly asset forth in claim 27 further including a cam cover affixed to the cylinder head assembly and enclosing the camshaft and wherein the first and second rocker arm shafts are carried by said cam cover.

29. A cylinder head assembly for an internal combustion engine comprising a plurality of poppet valves supported for reciprocation within said cylinder head, a camshaft rotatably journaled on said cylinder head, first rocker arm means engaged with said camshaft and with certain of said valve means for operating said valve means, said first rocker arm means being pivotally supported on a first rocker arm shaft, a plurality of second rocker arms engaged with said camshaft for operating the remainder of said valves, said second rocker arms being pivotally supported on a second rocker arm shaft, said second rocker arm shaft being spaced a different distance from the lower surface of said cylinder head than said first rocker arm shaft, and a cam cover affixed to said cylinder head assembly and enclosing said camshaft and said first and second rocker arm shafts being carried by said cam cover.

* * * * *

UNITED STATES PATENT AND TRADEMARK OFFICE

CERTIFICATE OF CORRECTION

PATENT NO. : 5,127,380

DATED : July 7, 1992

INVENTOR(S) : Isao Morishita

It is certified that error appears in the above-identified patent and that said Letters Patent is hereby corrected as shown below:

Column 11, line 43, Claim 9, "lobe" should be --lobes--.

Column 11, line 61, Claim 14, "three" (first occurrence) should be --there--.

Column 11, line 66, Claim 15, "bifurated" should be --bifurcated--.

Column 13, line 9, Claim 28, "asset" should be --as set--.

Signed and Sealed this

Twenty-eighth Day of September, 1993

Bruce Lehman

*Attest:*

BRUCE LEHMAN

*Attesting Officer*

*Commissioner of Patents and Trademarks*